US010156413B2

(12) United States Patent
Heurlin

(10) Patent No.: US 10,156,413 B2
(45) Date of Patent: Dec. 18, 2018

(54) LINE-OF-SIGHT APPARATUS LOCKING ARRANGEMENT WITH FRONT AND REAR FASTENER

(71) Applicant: SAAB AB, Linköping (SE)

(72) Inventor: Gustav Heurlin, Stockholm (SE)

(73) Assignee: SAAB AB, Linköping (SE)

( * ) Notice: Subject to any disclaimer, the term of this patent is extended or adjusted under 35 U.S.C. 154(b) by 33 days.

(21) Appl. No.: 15/311,286

(22) PCT Filed: May 15, 2014

(86) PCT No.: PCT/SE2014/050590
§ 371 (c)(1),
(2) Date: Nov. 15, 2016

(87) PCT Pub. No.: WO2015/174897
PCT Pub. Date: Nov. 19, 2015

(65) Prior Publication Data

US 2017/0089658 A1 Mar. 30, 2017

(51) Int. Cl.
*F41A 23/00* (2006.01)

(52) U.S. Cl.
CPC ..... *F41A 23/005* (2013.01)

(58) Field of Classification Search
CPC ..... B25B 13/18; B25B 13/22; B25B 1/12; B25B 1/14; F41A 23/00; F41A 23/005
See application file for complete search history.

(56) References Cited

U.S. PATENT DOCUMENTS

| | | | | |
|---|---|---|---|---|
| 2,397,239 A | | 3/1946 | Brown | |
| 2,403,591 A | | 7/1946 | Ewart | |
| 2,415,340 A | | 2/1947 | Ardenne et al. | |
| 2,427,365 A | | 9/1947 | Meister | |
| 2,582,140 A | * | 1/1952 | Leek | F41A 23/16 42/94 |
| 2,651,959 A | | 9/1953 | Harrington | |
| 2,868,080 A | * | 1/1959 | Meyer | F41A 23/005 89/37.03 |
| 2,870,683 A | | 1/1959 | Wilson | |

(Continued)

FOREIGN PATENT DOCUMENTS

DE 3613104 A1 10/1987

OTHER PUBLICATIONS

PCT/ISA/210—International Search Report—dated Feb. 6, 2015 (Issued in Application No. PCT/SE2014/050590).

(Continued)

*Primary Examiner* — Michael D David
(74) *Attorney, Agent, or Firm* — Venable LLP; Jeffri A. Kaminski

(57) ABSTRACT

A line-of-sight apparatus locking arrangement for demountably securing a line-of-sight apparatus to the arrangement is provided. The arrangement includes a first and second locking devices, each of which includes a handle member adapted for attachment to a rotation mechanism. The rotation mechanism is coupled to a translation mechanism adapted for, during maneuver of the locking devices, converting rotational motion into translator motion. The translation mechanism includes a pressing portion provided for abutment against an abutment area of the apparatus.

11 Claims, 4 Drawing Sheets

(56) References Cited

U.S. PATENT DOCUMENTS

| | | | | | |
|---|---|---|---|---|---|
| 4,026,057 | A * | 5/1977 | Cady | F41A 23/16 | 42/94 |
| 4,333,385 | A * | 6/1982 | Culver | F41A 23/16 | 73/167 |
| 4,621,563 | A | 11/1986 | Poiencot | | |
| 4,876,814 | A * | 10/1989 | Lombardo | F41A 23/04 | 42/94 |
| 4,967,640 | A | 11/1990 | Dodd | | |
| 5,070,636 | A * | 12/1991 | Mueller | F41A 23/16 | 42/94 |
| 5,661,919 | A * | 9/1997 | Pryor | F41A 23/16 | 42/94 |
| 5,933,999 | A * | 8/1999 | McClure | B60R 7/14 | 42/94 |
| 5,937,561 | A | 8/1999 | Abernethy | | |
| 7,454,858 | B2 * | 11/2008 | Griffin | F41C 23/16 | 42/71.01 |
| 7,823,317 | B2 * | 11/2010 | Potterfield | F41A 23/16 | 248/121 |
| 7,886,474 | B2 * | 2/2011 | Werner | F41A 23/16 | 42/94 |
| 7,954,272 | B2 * | 6/2011 | Potterfield | F41A 23/10 | 248/125.8 |
| 7,963,206 | B2 * | 6/2011 | Bartle | F41A 23/16 | 42/94 |
| 8,006,426 | B1 * | 8/2011 | Carroll | F41A 23/14 | 42/94 |
| 8,621,773 | B2 * | 1/2014 | Morrow | F41A 23/16 | 42/94 |
| 8,931,201 | B2 * | 1/2015 | Gianladis | F41A 23/18 | 42/94 |
| 9,206,941 | B2 * | 12/2015 | Smith | F16M 11/04 | |
| 2005/0257680 | A1 | 11/2005 | Russell | | |
| 2006/0218840 | A1 | 10/2006 | Cauley | | |
| 2017/0108305 | A1 * | 4/2017 | Heurlin | F41A 23/005 | |

OTHER PUBLICATIONS

PCT/IPEA/408—Written Opinion of the International Preliminary Examining Authority—dated Apr. 18, 2016 (Issued in Application No. PCT/SE2014/050590).

PCT/IPEA/416—Notification of Transmittal of International Preliminary Report on Patentability—dated Sep. 6, 2016 (Issued in Application No. PCT/SE2014/050590).

PCT/IPEA/409—International Preliminary Report on Patentability—dated Sep. 6, 2016 (Issued in Application No. PCT/SE2014/050590).

Extended European Search Report dated Dec. 7, 2017, in corresponding European Application No. 14891753.7 (7 pages).

* cited by examiner

Fig. 4
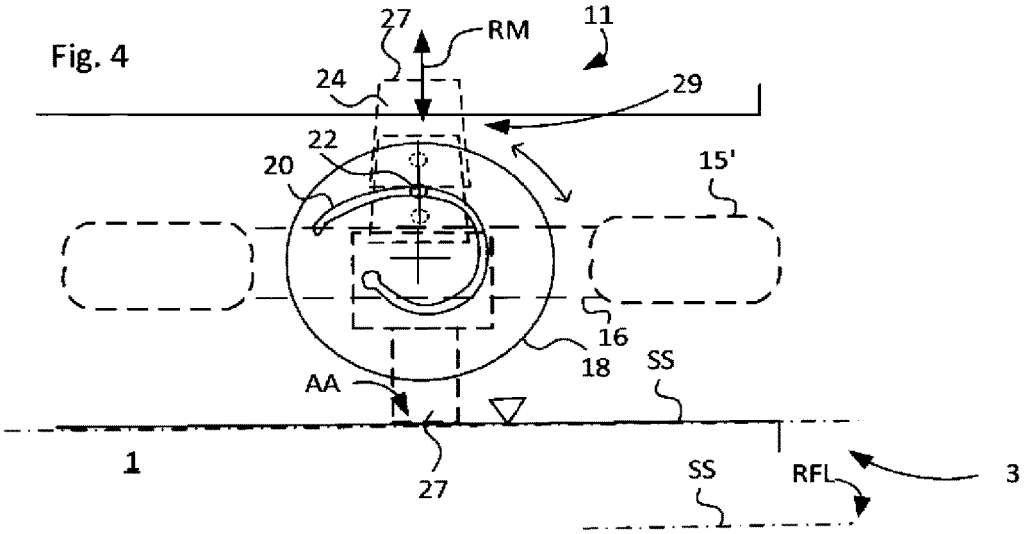
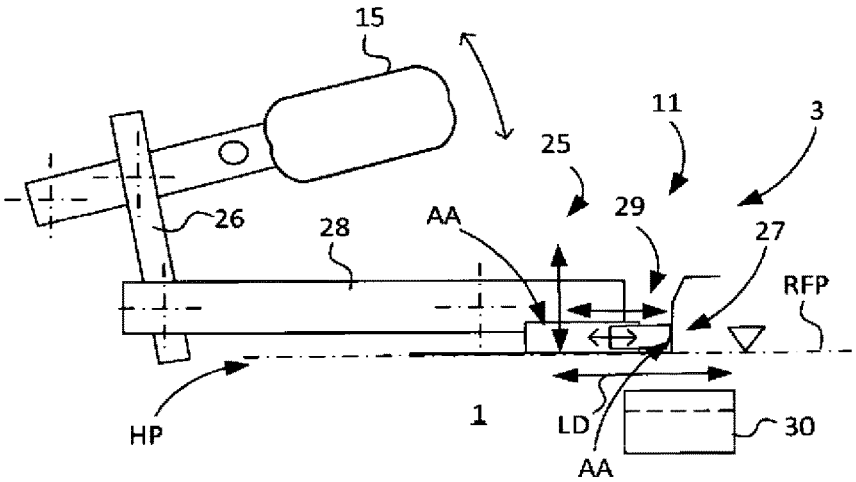
Fig. 5a
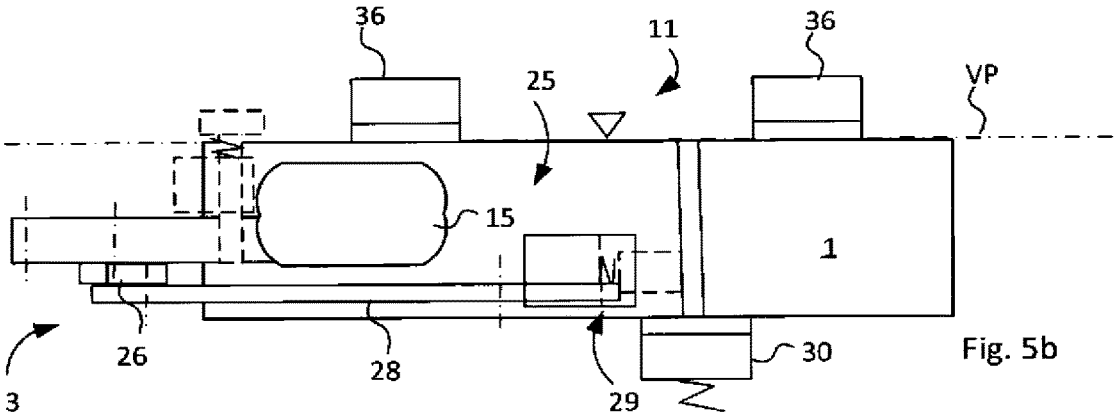
Fig. 5b

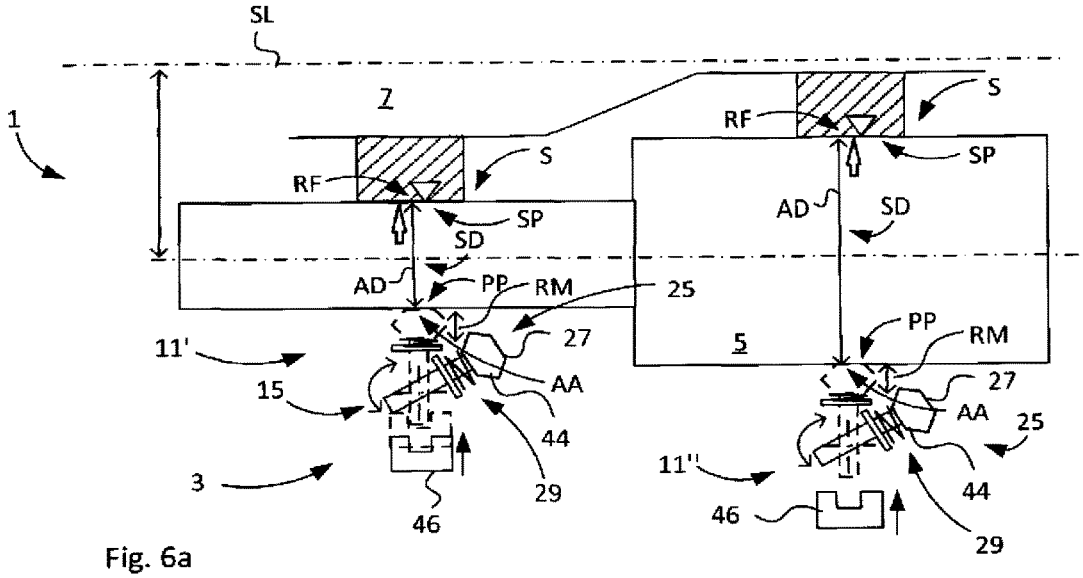
Fig. 6a
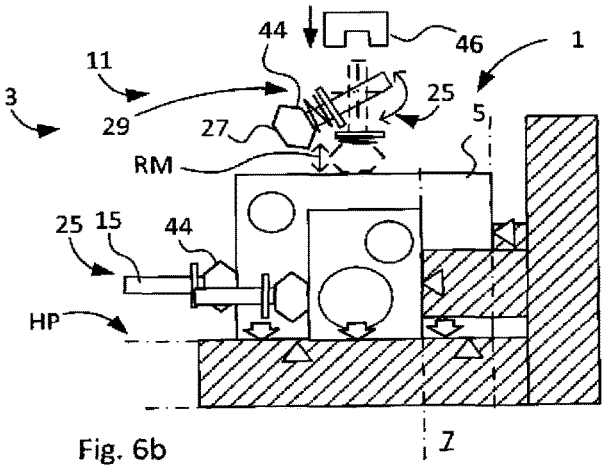
Fig. 6b
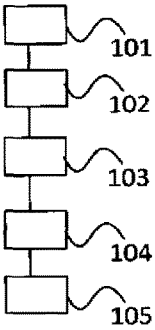
Fig. 10
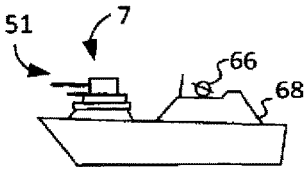
Fig. 7b
Fig. 7a
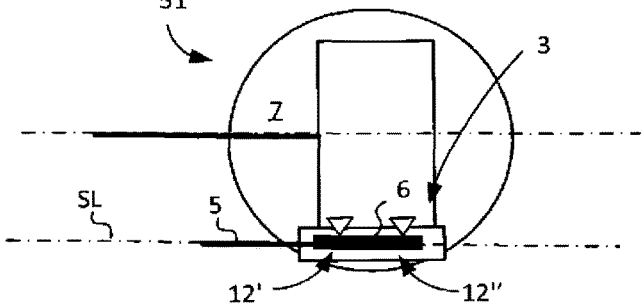

LINE-OF-SIGHT APPARATUS LOCKING ARRANGEMENT WITH FRONT AND REAR FASTENER

CROSS-REFERENCE TO RELATED APPLICATIONS

The application claims priority to the national phase under 35 U.S.C. § 371 of PCT/SE2014/050590 filed 15 May 2014.

TECHNICAL FIELD

The present invention relates to a line-of-sight apparatus locking arrangement and a method for locking the apparatus to the arrangement.

The invention relates to mounting arrangements adapted for mountings of line-of-sight apparatuses, such as machine guns, automatic guns, remote weapon systems, light weight cannons, training sensor equipped devices, tank-mounted coaxial weapons, light weight general purpose machine guns and other line-of-sight apparatuses.

The invention is not limited thereto, but can be used also for arrangements adapted for mounting of other weapon and sight and/or sensor apparatuses or other training devices.

BACKGROUND ART

There is a desire to provide a mounting and locking device and locking arrangement for achieving rapid mount and demount of an apparatus, such as a general machine gun, a coaxial machine gun for example, to a weapon station or remote controlled weapon platform or others.

For some time now engineers have made weapon mounting arrangements for quick mounting and demounting of different types of machine guns to corresponding platforms. However, these designs do not provide rigid securement of the apparatuses to the arrangement. Prior art arrangements exhibit e.g. too much play, which results in inferior accuracy of fire. Arrangements are also used, wherein a machine gun is tightly fixed to a sub-structure with bolts.

U.S. Pat. No. 2,403,591 describes a front end of a machine gun being fixed to a yoke member of a locking arrangement. A clamping screw is mounted into a bore of the front end. A bolt head of the clamping screw bears against the arrangement for holding the front end rigidly to the yoke member. Lock nuts are provided for locking an adjusting screw in an adjusted position. A carriage of the arrangement is adapted to carry a back end of the machine gun. The carriage is arranged for slidably and pivotally supporting the back end and clamping screws are tightened.

U.S. Pat. No. 2,415,340 reveals a gun mount arrangement with a front locking pin and a rear locking pin. The gun has a front transverse hole and a rear transverse hole. The locking pins are passed through the holes and corresponding bores of the arrangement for securing the gun to the arrangement.

Prior art locking devices thus often fixate the receiver of the weapon in a way so that internal stress occurs in the weapon receiver resulting in bolt jam or inferior accuracy of aim or other failure.

There is an object to provide a line-of-sight apparatus locking arrangement, herein also called arrangement, which can be used for rigidly holding a specific variant (type of gun, sensor etc.) of apparatus, wherein the apparatus not primary being designed for rigidly attachment to a sub-structure, and wherein such apparatus easy can be mounted and de-mounted to the arrangement. Different types of apparatuses (machine guns etc.) exhibit different interfaces or measures.

There is an object that each time the user mounts the apparatus to the arrangement, the arrangement will hold the apparatus in a position that is similar for each time and corresponds to previous mounting so that the accuracy of aim will satisfying every time.

There is an object to provide an arrangement that can be attached (mounted) to a weapon station and being so adjusted relative the weapon station sight-line, so that front and rear supporting points of the arrangement correspond to said sight line in pre-determined positions.

There is an object to provide an arrangement comprising said pre-determined positions of the supporting points of the arrangement, so that an apparatus (mounted or attached to the arrangement and thus to the weapon station) always will exhibit apparatus sight-line corresponding with weapon station sight-line, parallel or in other way related to the weapon station sight-line.

There is an object to provide an arrangement, to which an apparatus, such as a weapon or sensor device, or other, can be rigidly mounted and secured and that at the same time still will guarantee accuracy of fire each time the apparatus is mounted to the arrangement.

There is an object to provide a secure and play-free fixation of the abutment area of the apparatus to the arrangement in an efficient way, also if different tolerances of same variant apparatuses are present. The abutment area is defined as a section of the apparatus where the locking device is in engagement with the apparatus.

There is an object to provide an arrangement adapted for demountable mountings of a machine gun in two attachment/locking points, i.e. front and rear positions of the receiver of the machine gun.

There is an object to achieve a rigid mount of the apparatus to the arrangement irrespective of different measure due to different wear of different apparatuses of the same type or variant. Often the transverse measure of one individual gun, when mounted and in abutment position will differ from transverse measure of another gun.

This is due despite the fact that the guns are of the same type or variant. Such tolerance range thus does exist to some extent, and there is a desire that such tolerance range does not influence upon the sight line or accuracy of aim of the apparatus mounted to the arrangement.

There is an object to provide an arrangement that always provides accuracy of aim, regardless of which individual apparatus that is mounted to the arrangement.

There is an object to provide an arrangement, whereby the apparatus can be mounted and de-mounted to the arrangement in a quick and easy way.

There is an object that the apparatus can be mounted and demounted without any external tools.

There is an object to provide an arrangement, which from educational point of view is easy to handle and use.

There is an object to achieve accuracy of aim under repetitive fire even though the apparatus or machine gun is secured to a platform perimeter or lateral position.

There is an object to provide an arrangement which in general provides accuracy of fire and wherein the apparatus, or weapon, is rigidly mounted and secured to the arrangement.

SUMMARY OF THE INVENTION

This has been achieved by the line-of-sight apparatus locking arrangement defined in the introduction and being characterized by the features of the characterizing part of claim 1.

In such way is achieved that the apparatus, such as a general machine gun or sensor device or others, is rigidly secured to the arrangement.

Thereby is achieved that the apparatus can be mounted and demounted to the arrangement rapidly, which is advantageously in case of ambush or regrouping before offensive combat action.

Suitably, the translation mechanism comprises a resilient member provided for urging said pressing portion against the abutment area.

Thereby is achieved that the force clamping the apparatus in place will correspond to a desired pre-determined force. The clamping force can thus be constant independent of tolerances.

The clamping force of first and second locking devices respectively can thus be pre-determined set from specific criteria, such as type of weapon, wear etc.

In such way is achieved that a reference point of the apparatus can be held at a supporting point of the apparatus at a predetermined position, which supporting point is related to the line-of-sight of the apparatus.

Preferably, a first apparatus distance taken from the pressing portion to a reference point of the apparatus corresponds to a second distance taken from the abutment area to a supporting point of the arrangement.

As a spring force, acting upon the abutment area via the pressing portion, will urge the reference point of the apparatus to rest against the supporting point of the arrangement, the first distance will always be the same as the second distance.

Preferably, the arrangement is adapted for a self-centering functionality of the locking device.

In such way is also achieved that a central weapon station promotes accuracy of aim under repetitive fire (or occasional fire) after mounting of the apparatus to the arrangement.

The position of the pressing portion is achieved by the resilient member translating the pressing portion in a direction towards the supporting point of the arrangement.

In such way is achieved that no internal stress will occur in a longitudinal direction of the apparatus. Prior art locking devices often fixate the receiver of the weapon so that internal stress occurs resulting in bolt jam or inferior accuracy of aim.

In such way the measure between the abutment area and the reference point of the apparatus corresponds with the measure between the pressing portion and the supporting point of the arrangement. This implies that even if wear (and/or high range of tolerance variation) of a set of apparatuses of the same type implies that each individual apparatus has a specific dimension different from others within this apparatus section provided for the locking device, the first distance is the same as the second distance. Thereby the reference point will always correspond to the supporting point of the arrangement. The supporting point of the arrangement is in turn defined in relation to the apparatus station sight line.

A first locking device and a second locking device will thus provide a first reference point and a second reference point respectively. The first and the second reference points are in well-defined positions and accordingly first and second supporting points of the arrangement are interrelated to the apparatus station sight line.

Suitably, the first locking device is a receiver front part locking device and the second locking device is a receiver rear part locking device.

Preferably, the translation mechanism is adapted to convert the rotational motion into a rectilinear motion.

In such way is achieved that the apparatus can be mounted and demounted without any external tools. By means of the apparatus is achieved that the mounting and demounting is easy to understand and from educational aspect also involves efficient handling of the locking device.

Suitably, the translation mechanism is adapted to convert the rotational motion into a curvilinear motion.

In such way is achieved that the apparatus can be mounted and demounted without any external tools. By means of the apparatus is achieved that the mounting and demounting handling is easy to understand and from educational aspect also involves efficient handling of the locking device.

Preferably, the translation mechanism comprises a screw member.

In such way is achieved a cost-effective production of the arrangement at the same time as the arrangement is reliable in service.

Suitably, the translation mechanism comprises a crank member.

In such way is provided a direct translation action from rotational motion to translator motion.

Preferably, the translation mechanism comprises a lever mechanism adapted to clamp the apparatus via the abutment area and locking the apparatus to the arrangement.

The resilient member provided a constant clamping force (regardless of wear and/or variance in tolerance of the apparatus) that provides a fixation of the apparatus to the arrangement. The lever mechanism is provided for urging said pressing portion against the abutment area, and strengthening such fixation and securing the abutment.

Thereby is thus provided that a clamping force will be constant irrespective of different measure tolerances of different apparatuses of the same type, within a section of the abutment and locking position (i.e. the section of the apparatus, where the locking device is in engagement with the apparatus) and/or irrespective of different measure due to different wear of different apparatuses of the same type.

Preferably, the resilient member comprises at least one conical spring washer. Thereby is achieved that the clamping force, providing fixation of the apparatus to the arrangement, will be constant irrespective of different measure tolerances of different apparatuses of the same type.

Suitably, the arrangement comprises a receiver front locking device and a receiver rear locking device.

Thereby is achieved that the apparatus can be mounted and demounted to the arrangement in a rapid way, which is advantageously in case of ambush or regrouping before offensive action. The arrangement also provides that a machine gun can be mounted rigidly in two positions to an arrangement by front and rear locking devices of the arrangement.

Preferably, the front locking device comprises a rectilinear translation mechanism. In such way can a bore opening of the front part of the receiver suitably is used for mounting, by linear inserting a holding pin member into the bore opening of the apparatus.

Suitably, the rear locking device comprises a curvilinear translation mechanism. Thereby is achieved that the curvilinear motion can be used as a motion of a lever mechanism that will move the pressing portion in a direction corresponding with the longitudinal centre line of the apparatus.

Preferably, the arrangement is adapted with a locking mechanism arranged for locking the handle member in a locked position for preventing rotation of the handle member.

In such way is achieved that unwanted unlocking of the locking device is avoided.

Suitably, the line-of-sight apparatus is an automatic gun.

Preferably, the line-of-sight apparatus is a sensor device.

In such way is achieved that a training system can be used in a similar way as used in live combat situations.

In such way is achieved that a sensor device in a secure and quick way can be mounted to the arrangement.

This is also solved by a weapon station comprising said arrangement.

Thereby is achieved an arrangement of low weight, which is advantageous from handling aspect of the arrangement when mounting it to a weapon station platform.

In such way is achieved that the apparatus, such as a weapon or sensor device, is rigidly secured to the arrangement.

Thereby is achieved a satisfying accuracy of aim under repetitive fire even though the weapon is secured to a platform perimeter or lateral position, i.e. offset centre and positioned beside centre main gun. Such coaxial weapon position requires extreme tight mount to the platform as moment from recoil also implies high accuracy of aim. Prior art arrangements have too much play, which results in inferior accuracy of fire. The weapon has to be rigidly mounted to the arrangement and in turn the platform, onto which the arrangement is positioned.

This has also been solved by the method.

In such way is achieved a safe and failure proof handling regarding the mounting of a gun to a platform and promoting accuracy of aim under repetitive fire (or occasional fire) after mounting of the apparatus to the arrangement.

BRIEF DESCRIPTION OF THE DRAWINGS

The present invention will now be described by way of examples with references to the accompanying schematic drawings, of which:

FIG. 4 illustrates a locking device of a line-of-sight apparatus locking arrangement according to one aspect;

FIGS. 5*a* and 5*b* illustrate a locking device of a line-of-sight apparatus locking arrangement according to one aspect;

FIGS. 6*a* and 6*b* illustrate a line-of-sight apparatus locking arrangement according to one aspect of the present invention;

FIGS. 7*a* and 7*b* illustrate a co-axial weapon comprising a line-of-sight apparatus locking arrangement according to one aspect of the present invention;

FIG. 10 illustrates a method according to one aspect of the invention.

DETAILED DESCRIPTION

Hereinafter, embodiments of the present invention will be described in detail with reference to the accompanying drawings, wherein for the sake of clarity and understanding of the invention some details of no importance may be deleted from the drawings.

Figure 1A:
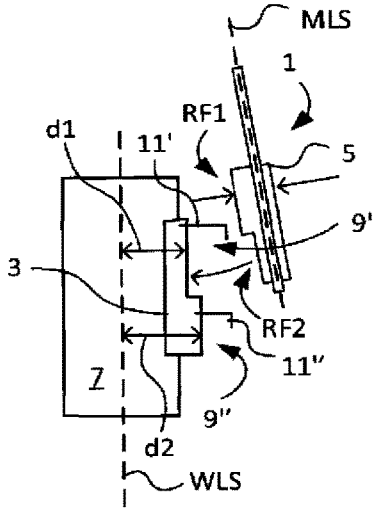
FIGS. 1*a* and 1*b* illustrate a line-of-sight apparatus locking arrangement according to one aspect of the present invention.
Figure 1B:
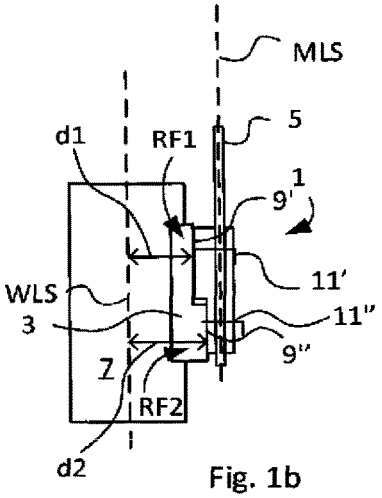

FIGS. 1*a* and 1*b* schematically illustrate a line-of-sight apparatus 1 locking arrangement 3, herein also called arrangement, according to one aspect of the present invention. FIG. 1*a* shows a machine gun 5 that is carried by a user (not shown) in combat and the user carries the machine gun 5 to a weapon station 7 (for example a remote weapon station RWS controlled from a remote position inside a vehicle or vessel) for mounting the machine gun 5 to the weapon station 7. The weapon station 7 exhibits a predetermined weapon station line-of-sight WLS properly defined in relation to used sensors and main weapon (not shown). FIG. 1*b* shows the machine gun 5 being mounted to the weapon station 7. The machine gun 5 is mounted to the arrangement 3. The arrangement 3 is beforehand attached to the weapon station 7 and adjusted so that line-of-sight MLS of a mounted machine gun 5 corresponds with the weapon station 7 line-of-sight WLS. This attachment is thus made so that a first 9' and second 9" supporting point of the arrangement 3 is in proper position relative the weapon station line-of-sight WLS. This relation is schematically illustrated by distance d1 and d2. Distance d1 is a distance predetermined from the first supporting point 9' to the weapon station 7 line-of-sight WLS and normal to the latter. Distance d2 is a distance pre-determined from the second supporting point 9" to the weapon station line-of-sight WLS and normal to the latter. The arrangement 3 comprises a first 11' and second 11" locking device. When the user mounts the machine gun 5 to the arrangement 3, the first 11' and second 11" locking device will secure and hold tight the machine gun 5 rigidly to the arrangement 3. A first RF1 and second RF2 reference point of the machine gun 5 for respective first 11' and second 11" locking device is thereby rigidly pressed onto and locked upon the respective first 9' and second 9" supporting points of the arrangement 3.

Figure 2:
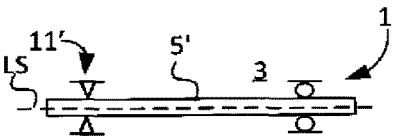
FIG. 2 illustrates a principle of one aspect according to the present invention.

FIG. 2 schematically illustrates a principle of one aspect according to the present invention. A weapon 5' is mounted to an arrangement 3. FIG. 2 shows the mounting from above. The first locking device 11' holds the weapon 5' front part rigidly in horizontal plane. The first locking device 11' holds the weapon 5' front part rigidly in vertical plane VP as well. The second locking 11" device holds the weapon 5' rear part rigidly in horizontal and vertical planes. The second locking device 11" additionally comprises a mechanism designed to permit freedom of movement in longitudinal direction as shown in FIG. 2. The longitudinal direction is defined as a direction corresponding with the longitudinal extension of the weapon 5'. By such freedom of movement is achieved that the line-of-sight LS is maintained unaffected and also is achieved that no functional trouble, such as bolt jamming, will occur.

Figure 3A:
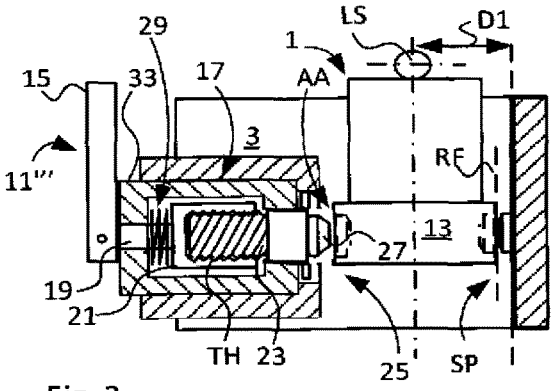
FIGS. 3*a* to 3*d* illustrate a locking device of a line-of-sight apparatus locking arrangement according to one aspect.
Figure 3B:
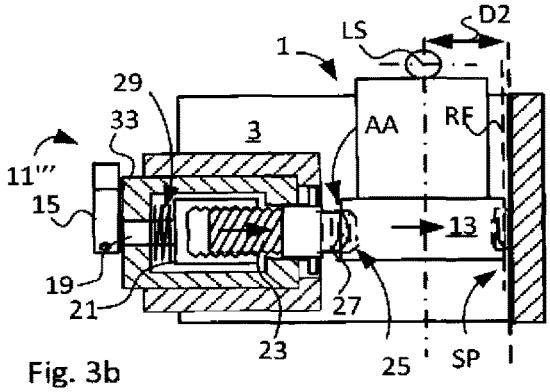

FIGS. 3*a* to 3*d* schematically illustrate a locking arrangement 3, according to one aspect. FIG. 3*a* shows the line-of-sight apparatus locking arrangement 3 for demountable securing a line-of-sight apparatus 1 to said arrangement 3. In FIG. 3*a* is shown that the apparatus 1 is positioned roughly by a user (not shown) in the locking device 11'" of the arrangement 3. The apparatus 1 comprises an abutment area AA of a fastening portion 13. The fastening portion 13 of the apparatus 1 also comprises a reference point RF, which is adapted to correlate with the arrangement's 3 line-of-sight LS. The line-of-sight LS of the apparatus 1 has a predetermined orientation relative the reference point RF. A supporting point SP of the arrangement 3 is determined to the arrangement's 3 line-of-sight LS in a manner as explained above in regard to FIG. 2. A distance taken orthogonally from apparatus 1 line-of-sight LS to the supporting point SP is marked with D1. The locking device 11''' comprises a hand grip 15 fixed to a rotation mechanism 17. The rotation mechanism 17 is in the form of an axis 19 rigidly connected to a sleeve 21 having internal thread TH. The internal thread TH is in engagement with a screw 23. The sleeve 21 is thus coupled to a translation mechanism 25 (comprising the screw 23) and adapted for, during maneuver of the locking device 11''' (as shown in following FIGS. 3*b* to 3*d*), converting rotational motion into translator motion. The translation motion is in this example straight or a so called rectilinear motion. By rotating the hand grip 15, the screw 23 moves towards the abutment area AA of the apparatus 1. The translation mechanism 25 comprising the screw 23 comprises a pressing portion 27 provided for abutment against the abutment area AA. In FIG. 3*b* is shown that the hand grip 15 is rotated a certain angle, wherein the sleeve 21 rotation moves the screw 23, which presses the pressing portion 27 towards the abutment area AA of the apparatus 1.

Figure 3C:
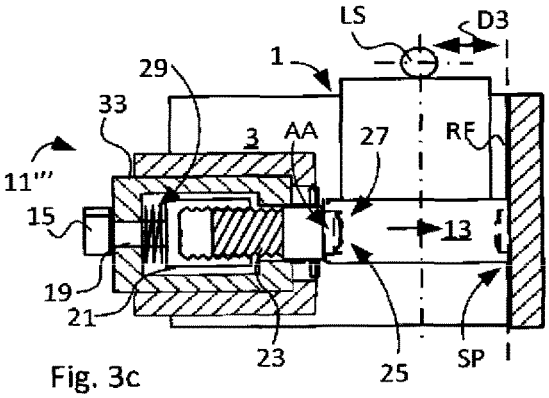
Figure 3D:
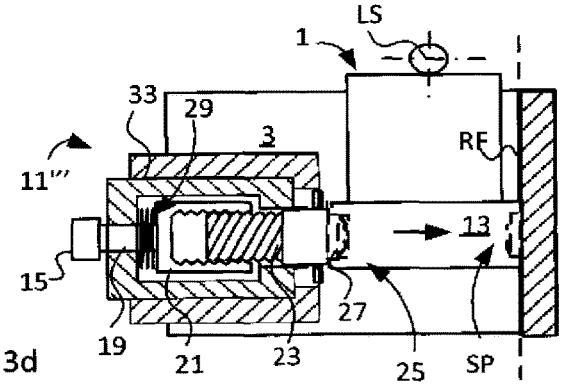

The fastening portion 13 thus moves towards the supporting point SP of the arrangement 3 and a distance from apparatus line-of-sight LS to the supporting point SP is achieved and marked with D2. In FIG. 3*c* is shown how the reference point of the apparatus 1 is in line with the supporting point SP and a distance from apparatus 1 line-of-sight LS to the supporting point SP is marked with D3. The hand grip 15 of each locking device has been rotated further by the user and the apparatus 1 is in position for firing. The rotation urges the pressing portion 27 towards the abutment area AA. A resilient member 29 (in the form of a stack of disc springs) is arranged between the sleeve 21 outer side and a house 33 housing the screw 23 and sleeve 21, will be compressed and presses the pressing portion 27 against the abutment area AA with a constant force. In FIG. 3*d* is shown that the apparatus 1 fastening portion 13 is of larger dimension than average due to tolerance derivation and as the user rotates the hand grip 15 to a pre-determined end position, as he has been instructed according to a manual for locking it in that position, the resilient 29 will be further compressed. But as the compression force is constant, the force holding the apparatus 1 fastening portion 13 will be the same for apparatuses having different tolerance measure in view of said dimension.

FIG. 4 schematically illustrates a locking device 11 of a line-of-sight apparatus 1 locking arrangement 3 according to one aspect. The FIG. 4 shows a locking device 11 comprising two grip members 15', which are fixed to an arm 16, which in turn comprises a crank motion disc 18 including a helical formed groove 20 in which a pin 22 is arranged to engage for achieving linear motion. The pin 22 is in turn fixed to a stud 24 which is arranged for rectilinear motion RM. The stud 24 comprises a pressing portion 27 provided for abutment against an abutment area AA of the apparatus 1. A resilient member 29 is provided for urging said pressing portion 27 against the abutment area AA, which member 29 provides a constant clamping force, when the grip members 15' are in locked position, regardless various tolerances of the apparatus 1 being mounted. The pressing portion 27 presses the apparatus 1 against a supporting surface SS with a constant pressing force (clamping force). The supporting surface SS corresponds with a reference line RFL.

FIGS. 5*a* and 5*b* schematically illustrate a locking device 11 of a line-of-sight apparatus 1 locking arrangement 3 according to one aspect. FIG. 5*a* shows the locking device 11 in a side view. A handle 15 is pivotally hinged for co-operating with a translation mechanism 25 comprising a push rod 26 acting upon a lever mechanism 28 adapted to clamp the apparatus 1 via the abutment area AA and locking the apparatus 1 to the arrangement 3. A resilient member 29 comprises a conical compression spring (not shown). It is provided for urging a pressing portion 27 of the lever mechanism 28 against the abutment area AA of the apparatus 1. The reference plane RFP is defined as a horizontal plane HP towards which the apparatus 1 is clamped. The apparatus 1 is free to move in longitudinal direction LD. For properly positioning the apparatus 1 relative a vertical reference plane VP (see FIG. 5*b*), a spring loaded shoulder 30 is arranged to urge the apparatus 1 in the horizontal plane HP towards supports 36. See also FIG. 5*b* illustrating the locking device 11 from above. The shoulder 30 adjusts the apparatus 1 in horizontal plane HP towards the vertical reference plane VP and the lever 28 clamps the apparatus 1 against the horizontal plane (reference plane RFP).

FIGS. 6*a* and 6*b* schematically illustrate a line-of-sight apparatus locking arrangement 3 according to one aspect of the present invention. FIG. 6*a* shows the arrangement 3 fixed to a weapon station 7. A machine gun 5 is mounted to the arrangement 3. A front locking device 11' and a rear locking device 11" is provided to the arrangement 3. A translation mechanism 25 is adapted to convert rotational locking motion into a rectilinear motion RM of a clamping head 44. After positioning the clamping head 44 in proper position, a securing slide 46 is moved in securing position for securing a handle 15 of respective locking device 11', 11". The translation mechanism 25 comprises a resilient member 29 provided for urging respective pressing portion 27 against respective abutment area AA of the apparatus 1. For each locking device 11', 11" is provide; a first apparatus 1 distance AD taken from a pressing portion point PP to a reference point RF of the machine gun 5 corresponds to a second distance SD taken from the abutment area AA to a supporting point SP of the arrangement 3. The resilient member 29 acts upon the abutment area AA via the pressing portion 27, wherein the reference point RF of the machine gun 5 will rest against the supporting point SP of the arrangement 3 and the first apparatus distance AD will always be the same as the second distance SD. The position of the pressing portion point PP is achieved by the resilient member 29 translating the pressing portion 27 in a direction towards the supporting point SP of the arrangement 3. In such way the measure between abutment area AA and reference point RF of the machine gun 5 corresponds to the measure taken between pressing portion point PP and the supporting point SP. This implies that even if wear (and/or high range of tolerance variation) of a set of machine guns 5 of the same type (meaning that each individual machine gun 5 has a dimension different from others within section S), the first distance AD is the same as the second distance SD. Thereby the reference point RF will always correspond to the supporting point SP of the arrangement 3. The supporting point SP of the arrangement 3 is in turn defined in relation to the weapon station sight line SL. In FIG. 6*h* the arrangement is shown in a front view.

FIGS. 7*a* and 7*b* schematically illustrate a co-axial weapon 51 comprising an arrangement 3 according to one aspect of the present invention. FIG. 7*a* shows the arrangement 3 with mounted machine gun 5. The machine gun 5 comprises a receiver 6. A front locking device is a receiver front part locking device 12' and a rear locking device is a receiver rear part locking device 12". According to one aspect of the invention the machine gun 5 is easy and quickly mounted by a user 66 to the coaxial weapon 51 and the arrangement 3 in such way that the sight line SL of the machine gun 5 corresponds to the pre-determined sight line. Due to the arrangement 3 according to one aspect, the machine gun 5 sight line SL will always be the same each time the user 66 mounts the machine gun 5 to the arrangement 3. FIG. 7*b* shows the co-axial weapon 51 used in a weapon station of a combat vessel 68. The machine gun 5 is remotely controlled the user 66.

Figure 8D:
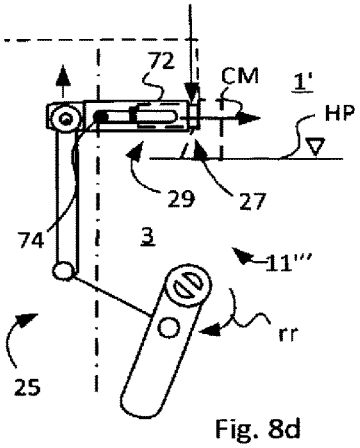
FIGS. 8*a* to 8*d* illustrate a locking device of a line-of-sight apparatus locking arrangement according to one aspect.
Figure 8C:
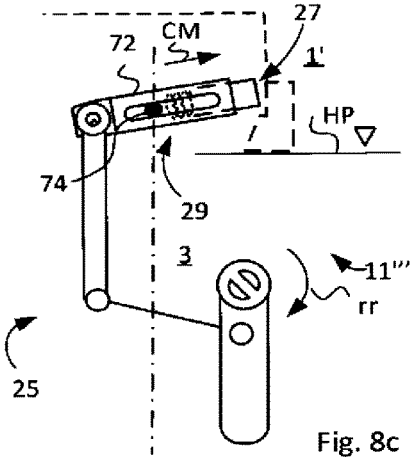
Figure 8B:
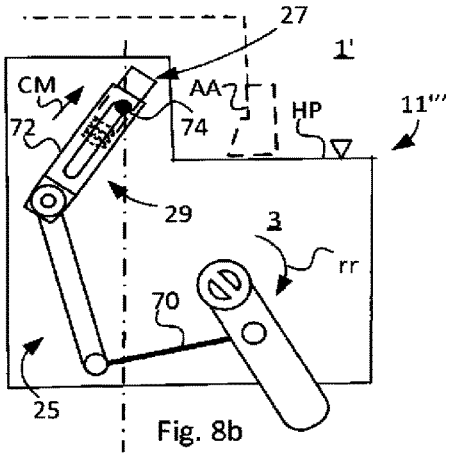
Figure 8A:
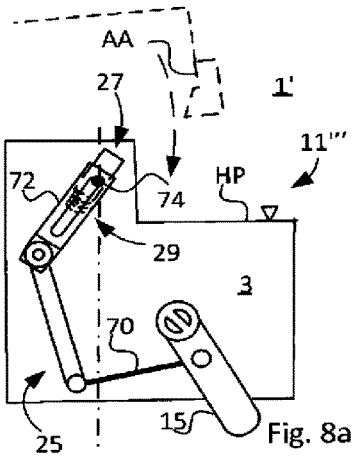

FIGS. 8*a* to 8*d* illustrate an arrangement 3 according to one aspect. The arrangement 3 and the locking device 11''' (only one is shown) being provided to hold a sensor device 1' used in combat training and simulation practice. FIG. 8*a* shows that the sensor device 1' is moved into position roughly onto the arrangement 3. FIGS. 8*b* to 8*d* show that during maneuver of the locking device 11''', a rotational motion rr being converted into translator motion in the form of curvilinear (curved) motion CM of a pressing portion 27 of the locking device 11'''. Each translation mechanism 25 comprises a respective pressing portion 27 provided for abutment against an abutment area AA of the sensor device 1'. The translation mechanism 25 comprises a resilient member 29 provided for urging the pressing portion 27 of the locking device 11''' towards the abutment area AA of the sensor device 1'. A first locking device is in the form of a sensor front part locking device and a second locking device is in the form of a sensor rear part locking device for achieving proper alignment of the sensor device 1' each time the sensor device 1' is mounted to the arrangement 3 by a soldier (not shown) during combat training. A crank arm 70 of the translation mechanism 25 provides movement of a lever arm 72 hinged over a crank motion pin 74 in motion downwards and backwards so that the pressing portion 27 of front part locking device and rear part locking device respectively, properly will come into clamping position for urging the sensor device 1' towards a horizontal plane HP. The sensor device 1' (by the insertion of the sensor device into the arrangement) will abut a vertical plane by means of a pair of spring loaded lips (not shown), respective lip being arranged in front and rear part.

Figure 9A:
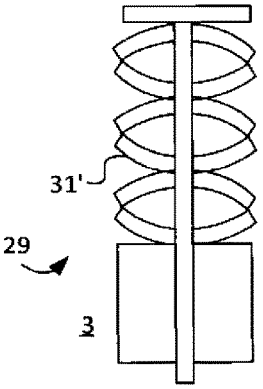
FIGS. 9*a* to 9*d* illustrate a resilient member comprising conical spring washers of a locking device of a line-of-sight apparatus locking arrangement according to one aspect of the present invention.
Figure 9B:
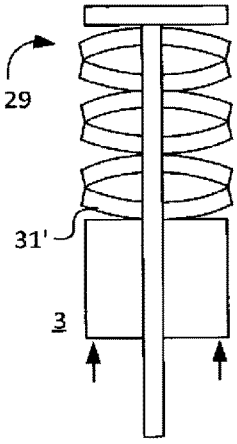
Figure 9C:
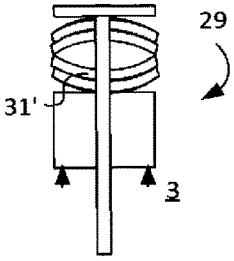
Figure 9D:
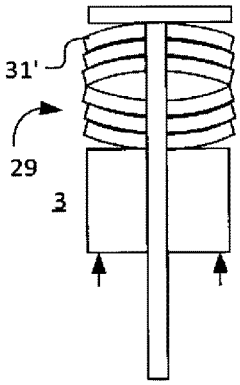

FIGS. 9*a* to 9*d* schematically illustrate a resilient member 29 comprising conical spring washers 31' of a locking device of a line-of-sight apparatus locking arrangement 3 according to one aspect of the present invention. Respective first and second locking device of the arrangement 3 comprises a resilient member 29 for clamping or holding a gun (not shown) to the arrangement with a constant pre-determined clamping force. According to one aspect, the resilient member 29 comprises six conical spring washers 31' as shown in FIGS. 9*a* and 9*b*. In FIG. 9*a* is shown unloaded state and FIG. 9*b* shows the loaded state. Even in case the resilient member 29 further being compressed caused by tolerance variation, for example thicker apparatus 1 front and rear part, the clamping force of the arrangement 3 still will be the same. In case the user wants to adapt the arrangement 3 to a larger dimension of the apparatus 1 front and rear part, he simply removes (as shown in FIG. 9*c*) a pair of spring washers 31'. In case the user wants to change the characteristics of the resilient member 29, he e.g. simply turns upside down selected spring washers 31' (as shown in FIG. 9*d*) for providing a stiffer mounting to the arrangement 3.

One aspect concerns a method for demountable securing the line-of-sight apparatus to a line-of-sight apparatus locking arrangement 3 comprising a first and second locking device each having a handle member 15 adapted for attachment to a rotation mechanism 17. The rotation mechanism is coupled to a translation mechanism 25 for converting rotational motion into translator motion. A pressing portion 27 of the translation mechanism 25 is adapted for abutment against an abutment area AA of the apparatus 1. The method comprises the steps of positioning the first locking device 11', 11" to the arrangement; positioning the second locking device 12', 12" to the arrangement; said positioning being performed by a self-centering functionality of the respective locking device 11', 11"; 12', 12"; rotating the respective rotation mechanism 17 by means of the handle member 15 for pressing each pressing portion 27 against the abutment area AA; and locking each handle member 15.

According to one aspect a method for demountable securing a line-of-sight apparatus 1 is shown schematically in the flow chart of FIG. 10. In this embodiment the line-of-sight apparatus locking arrangement comprises a first and second locking device 11, 12, each of which comprising a handle member 15 adapted for attachment to a rotation mechanism 17 coupled to a translation mechanism 25 for converting rotational motion into translator motion, a pressing portion 27 of the translation mechanism 25 is adapted for abutment against an abutment area AA of the apparatus 1. According to one aspect the method comprises the steps of positioning 101 the first locking device 11 to the arrangement; positioning 102 the second locking device (12) to the arrangement; said positioning being performed by a self-centering functionality of the respective locking device 11', 11"; 12', 12"; rotating 103 the respective rotation mechanism (17) by means of the handle member 15 for pressing each pressing portion 27 against the abutment area AA; and locking 104 each handle member 15.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims. Examples of suitably apparatuses to be mounted to the arrangement are machine guns, sensors, TV-cameras, general machine guns, firearms, small arms and others. Suitably weapon stations for encompassing the arrangement are co-axial weapon stations, remote controlled weapon stations, track fire stations, and others. The arrangement material can be cast steel, stainless steel, composite material, aluminum and other materials. There could be two, three or even four locking devices of the type described herein for locking the apparatus in position to the arrangement achieving a pre-determined sight-line. The locking devices of the arrangement may comprise different mechanisms adapted to convert the rotational motion into a rectilinear motion or into a curvilinear motion. The locking devices of the arrangement may all comprise a combination of the mechanisms adapted to convert the rotational motion into a rectilinear motion and into a curvilinear motion. The front locking device of the arrangement may comprise the mechanism adapted to convert the rotational motion into a rectilinear motion and the rear locking device of the arrangement may comprise the mechanism adapted to convert the rotational motion into a curvilinear motion.

The invention claimed is:

1. Line-of-sight apparatus locking arrangement for demountably securing a line-of-sight apparatus to said arrangement, said arrangement comprising:

a first locking device and a second locking device, each of which comprises a handle member adapted for attachment to a respective rotation mechanism of said arrangement wherein each rotation mechanism is coupled to a translation mechanism of said arrangement adapted for, during maneuver of the 1st and 2nd locking devices, converting a rotational motion into a translator motion, wherein:

each translation mechanism comprises a pressing portion provided for abutment against a respective abutment area of the apparatus;

each translation mechanism comprises a resilient member provided for urging said pressing portion against the abutment area such that the arrangement is clamped to said abutment area of the apparatus, wherein a position of the pressing portion is achieved by the resilient member translating the pressing portion in a direction towards a supporting point of the arrangement;

the first locking device comprises a rectilinear translation mechanism; and the second locking device comprises a curvilinear translation mechanism that moves the pressing portion in a direction corresponding with the longitudinal centre line of the line-of-sight apparatus.

2. The arrangement according to claim 1, wherein the translation mechanism is adapted to convert the rotational motion into a rectilinear motion.

3. The arrangement according to claim 1, wherein the translation mechanism is adapted to convert the rotational motion into a curvilinear motion.

4. The arrangement according to claim 1, wherein the translation mechanism comprises a screw member.

5. The arrangement according to claim 1, wherein the translation mechanism comprises a crank member.

6. The arrangement according to claim 5, wherein the translation mechanism comprises a lever mechanism adapted to clamp the apparatus via the abutment area and locking the apparatus to the arrangement.

7. The arrangement according to claim 1, wherein the resilient member comprises at least one conical spring washer.

8. The arrangement according to claim 1, wherein the handle member is adapted with a locking mechanism arranged for locking the handle member in a locked position for preventing rotation of the handle member.

9. The arrangement according to claim 1, wherein the line-of-sight apparatus is a gun.

10. The arrangement according to claim 1, wherein the line-of sight apparatus is a sensor device.

11. A method for demountably securing a line-of-sight apparatus to a line-of-sight apparatus locking arrangement, wherein said arrangement comprises a first locking device and a second locking device, each of the locking devices comprises a handle member adapted for attachment to a respective rotation mechanism of said arrangement, the rotation mechanism is coupled to a respective translation mechanism of said arrangement for converting a rotational motion into a translator motion, a pressing portion of each translation mechanism is adapted for abutment against a respective abutment area of the apparatus, and each translation mechanism comprises a resilient member provided for urging said pressing portion against the respective abutment area such that the arrangement is clamped to said apparatus, the method comprising:

positioning the first locking device to the arrangement;

positioning the second locking device to the arrangement;

rotating the respective rotation mechanism by means of the handle member for pressing each pressing portion against the abutment area; wherein the first locking device comprises a rectilinear translation mechanism, and wherein the second locking device comprises a curvilinear translation mechanism that moves the pressing portion in a direction corresponding with the longitudinal centre line of the line-of-sight apparatus; and locking each handle member.

* * * * *